US012480505B2

(12) United States Patent
Okuda et al.

(10) Patent No.: US 12,480,505 B2
(45) Date of Patent: Nov. 25, 2025

(54) AXIAL FAN

(71) Applicant: SANYO DENKI CO., LTD., Tokyo (JP)

(72) Inventors: Yusuke Okuda, Tokyo (JP); Jun Chieh Yen, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 0 days.

(21) Appl. No.: 18/937,134

(22) Filed: Nov. 5, 2024

(65) Prior Publication Data

US 2025/0163919 A1 May 22, 2025

(30) Foreign Application Priority Data

Nov. 17, 2023 (JP) ..... 2023-195819

(51) Int. Cl.
*F04D 19/00* (2006.01)
*F04D 29/52* (2006.01)

(52) U.S. Cl.
CPC ..... *F04D 19/007* (2013.01); *F04D 19/002* (2013.01); *F04D 29/522* (2013.01)

(58) Field of Classification Search
CPC .. F04D 19/0002; F04D 19/007; F04D 29/522; F04D 29/64
See application file for complete search history.

(56) References Cited

U.S. PATENT DOCUMENTS 6,612,817 B2 * 9/2003 Lin ..... F04D 29/522 415/199.5
8,123,461 B2 * 2/2012 Yoshida ..... F04D 19/007 415/214.1
8,133,006 B2 * 3/2012 Yoshida ..... F04D 25/0613 415/68
8,172,501 B2 * 5/2012 Nishizawa ..... F04D 19/024 415/214.1
8,932,014 B2 * 1/2015 Zhao ..... F04D 19/007 415/213.1
9,670,932 B2 * 6/2017 Iwamoto ..... F04D 29/522
11,319,970 B2 * 5/2022 Masuo ..... F04D 29/646

FOREIGN PATENT DOCUMENTS

JP 2013024042 A 2/2013

* cited by examiner

*Primary Examiner* — Nathaniel E Wiehe
*Assistant Examiner* — Jason G Davis
(74) *Attorney, Agent, or Firm* — RANKIN, HILL & CLARK LLP

(57) ABSTRACT

Provided is an axial fan including a first fan unit including a first housing, and a second fan unit including a second housing. Each end portion, in a rotation axis direction, of the axial fan has a base portion. A shell portion between the base portions is formed by the first housing and the second housing. A coupling structure of the first and second fan units includes a first structure, and a second structure provided to the second housing. At least part of the first structure protrudes from the first housing in the rotation axis direction. The first structure can fit into the second structure when the first and second fan units come closer to each other to rotate about the rotation axis. At least part of the coupling structure is embedded in the shell portion.

4 Claims, 4 Drawing Sheets

AXIAL FAN

CROSS-REFERENCE TO RELATED APPLICATION

This application is based on Japanese Patent Application No. 2023-195819 filed with the Japan Patent Office on Nov. 17, 2023, the entire content of which is hereby incorporated by reference.

BACKGROUND

1. Technical Field

The present disclosure relates to an axial fan.

2. Related Art

In an axial fan described in JP-A-2013-024042, an axial fan including frames fixed to each other with a screw is disclosed.

In known axial fans, a mechanism for coupling fan frames is provided to a side surface of the fan in some cases.

However, the number of steps of coupling frames of a fan tends to increase in the above-mentioned structure. In addition, the number of components also tends to increase. As a result, the assembly process is complicated.

Hence, an object of the embodiments is to provide an axial fan that allows simplification of a process of mounting the axial fan and a process of assembling the axial fan itself.

SUMMARY

An axial fan according to the embodiments of the present disclosure includes a first fan unit, and a second fan unit, in which the first fan unit and the second fan unit are coupled in a direction of a rotation axis, the first fan unit includes a first housing for accommodating a first fan, the second fan unit includes a second housing for accommodating a second fan, each end portion of the axial fan in the direction of the rotation axis is provided with a base portion, a cylindrical shell portion is provided between the base portions provided to the end portions, and is formed by the first housing and the second housing, a coupling structure of the first fan unit and the second fan unit is provided, the coupling structure includes a first coupling structure and a second coupling structure, at least part of the first coupling structure protrudes in the direction of the rotation axis from an end portion of the first housing in the direction of the rotation axis toward the second fan, the second coupling structure is provided to the second housing, the first coupling structure is configured in such a manner as to fit into the second coupling structure upon the first fan unit and the second fan unit coming closer to each other in the direction of the rotation axis and then rotating about the rotation axis, and at least part of the coupling structure is embedded in an outer peripheral side surface of the shell portion.

DETAILED DESCRIPTION

Figure 1:
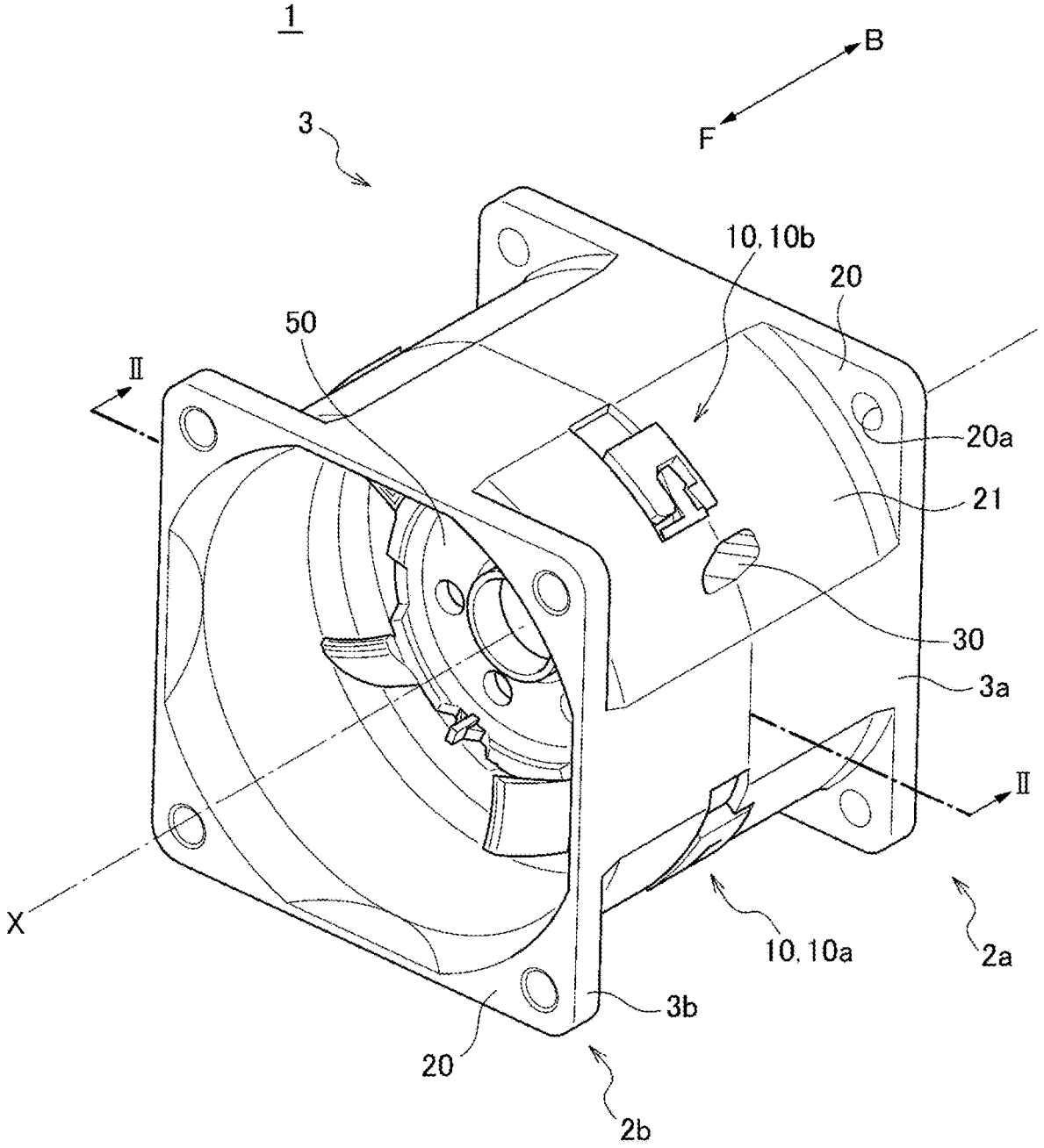
FIG. 1 is a perspective view illustrating an example of an axial fan according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An axial fan according to one aspect of the present disclosure is an axial fan including a first fan unit, and a second fan unit, in which the first fan unit and the second fan unit are coupled in a direction of a rotation axis, the first fan unit includes a first housing for accommodating a first fan, the second fan unit includes a second housing for accommodating a second fan, each end portion of the axial fan in the direction of the rotation axis is provided with a base portion, a cylindrical shell portion is provided between the base portions provided to the end portions, and is formed by the first housing and the second housing, a coupling structure of the first fan unit and the second fan unit is provided, the coupling structure includes a first coupling structure and a second coupling structure, at least part of the first coupling structure protrudes in the direction of the rotation axis from an end portion of the first housing in the direction of the rotation axis toward the second fan, the second coupling structure is provided to the second housing, the first coupling structure is configured in such a manner as to fit into the second coupling structure upon the first fan unit and the second fan unit coming closer to each other in the direction of the rotation axis and then rotating about the rotation axis, and at least part of the coupling structure is embedded in an outer peripheral side surface of the shell portion.

According to the embodiments, it is possible to provide an axial fan that allows simplification of a process of mounting the axial fan and a process of assembling the axial fan itself.

Embodiments of the present disclosure are described hereinafter with reference to the drawings. Note that descriptions of members having the same reference numerals as members already described are omitted in the detailed description for convenience of description. Moreover, the dimensions of each member illustrated in the drawings may be different from actual dimensions thereof for convenience of description.

Note that letters F and B presented in, for example, FIG. 1 indicate directions in an axial fan 1. The letter F indicates forward. The letter B indicates backward. The air-blowing direction of the axial fan 1 is defined as the front-and-back direction.

FIG. 1 is a perspective view illustrating an example of the axial fan 1 according to an embodiment of the present disclosure. The axial fan 1 can produce currents of air parallel to a rotation axis X. The axial fan 1 according to the embodiment of the present disclosure is mounted in, for example, an external apparatus of an information processing apparatus such as a server.

As illustrated in FIG. 1, the axial fan 1 includes a pair of fan units 2. The pair of fan units 2 includes a first fan unit 2*a* and a second fan unit 2*b*, which are connected in series to each other. The first fan unit 2*a* and the second fan unit 2*b* share the rotation axis X. Each of the first fan unit 2*a* and the second fan unit 2*b* is provided with a fan. The first fan unit 2*a* is provided with a first fan (not illustrated). The second fan unit 2*b* is provided with a second fan (not illustrated). In the illustrated example, the first fan unit 2*a* is placed backward of the second fan unit 2*b*.

The axial fan 1 is a contra-rotating fan. In other words, the rotation direction of the first fan is different from the rotation direction of the second fan. For example, air is taken in through the second fan unit 2*b*. The air is then discharged from the first fan unit 2*a*. In this manner, the axial fan 1 according to the embodiment is a contra-rotating fan including two fans that rotate in opposite directions. However, in the configuration of the axial fan 1, two fans that rotate in the same direction may be connected in series. In the example of FIG. 1, the second fan unit 2*b* is attached to the first fan unit 2*a* with a posture where the first fan unit 2*a* is turned around in the front-and-back direction.

As illustrated in FIG. 1, the first fan unit 2*a* includes a first housing 3*a*. The first housing 3*a* is provided in such a manner as to cover a radial perimeter of the above-mentioned first fan. Moreover, similarly, the second fan unit 2*b* includes a second housing 3*b*. The second housing 3*b* is provided in such a manner as to cover a radial perimeter of the above-mentioned second fan.

Figure 2:
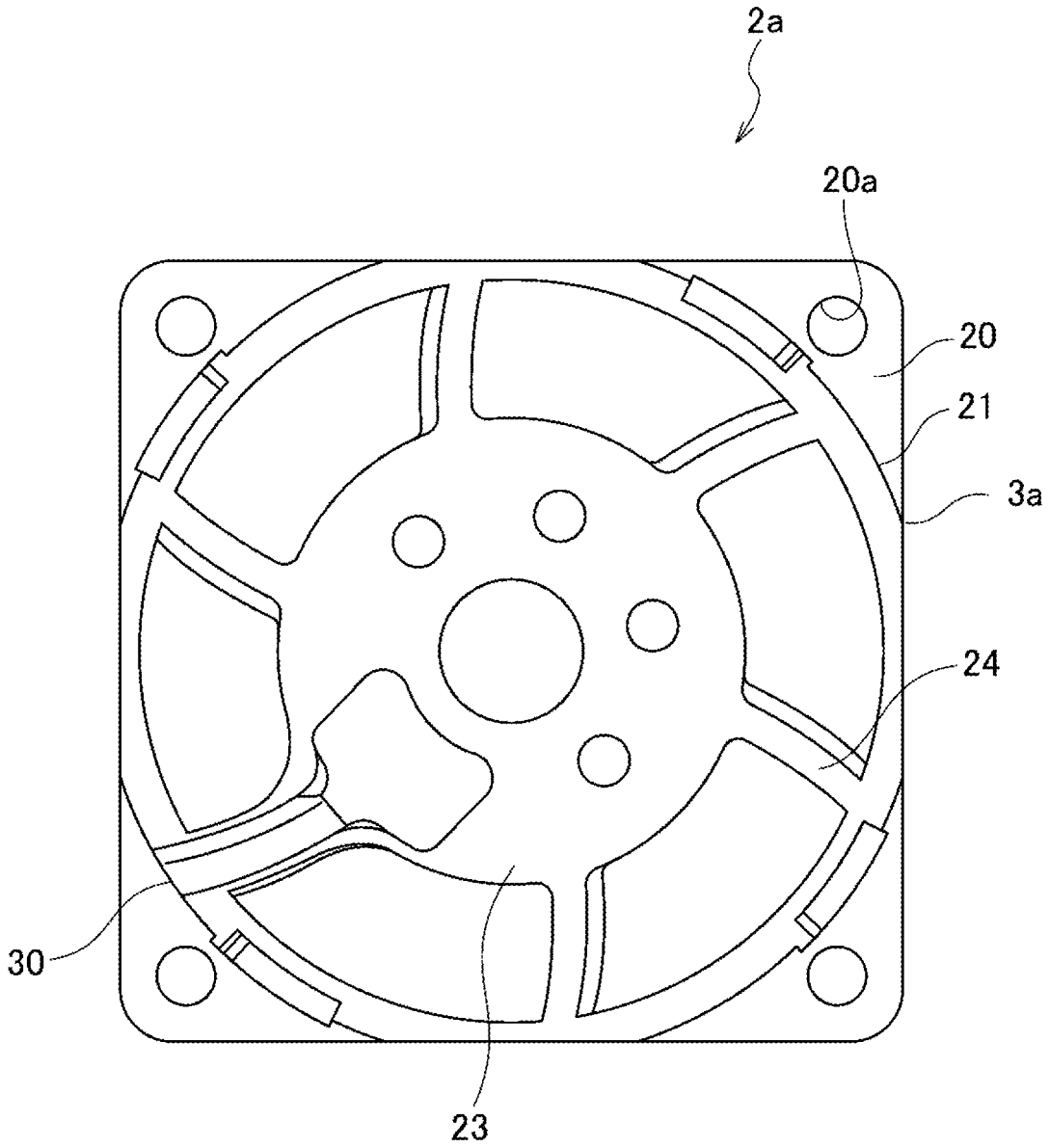
FIG. 2 is a cross-sectional view on arrows II-II of FIG. 1.

The housing of the fan unit 2 is described in detail below with reference to FIGS. 1 and 2. FIG. 2 is a cross-sectional view on arrows II-II of FIG. 1. FIG. 2 illustrates the first housing 3*a*. Note that in FIG. 2, the first housing 3*a* is described as an exemplification. However, the configuration of the first housing 3*a*, which is described below, is the same as the configuration of the second housing 3*b*.

As illustrated in FIGS. 1 and 2, the first housing 3*a* further includes a base portion 20, a shell portion 21, a root portion 23, and a spoke portion 24, and has a coupling structure 10. The base portion 20 is provided to a back end portion of the first fan unit 2*a*. The base portion 20 has a rectangular shape extending in a direction orthogonal to the rotation axis X. The base portion 20 further includes an attachment through-hole 20*a*. The axial fan 1 can be screwed to an external apparatus by use of the attachment through-hole 20*a*. The shell portion 21 is a member that covers the outer periphery of the fan. The shell portion 21 is a cylindrical member extending forward from the base portion 20. The shell portion 21 further includes the coupling structure 10 and a through-hole 30. The through-hole 30 is provided to the shell portion 21. The through-hole 30 is provided to enable installation of wiring from a motor of the fan provided in the shell portion 21 to the outside of the shell portion 21. In the embodiment, the through-hole 30 is formed in such a manner as to be astride both of the first housing 3*a* and the second housing 3*b*. The first housing 3*a* and the second housing 3*b* are mounted on each other, thereby forming the through-hole 30. The above configuration enables the checking of whether or not the through-hole 30 has been appropriately formed upon the assembly of the axial fan 1 itself. Consequently, it is possible to determine whether or not the axial fan 1 has been appropriately assembled. Note that the form of the through-hole 30 is not limited to the above-mentioned form. For example, the through-hole 30 may be provided to either the first housing 3*a* or the second housing 3*b*. The root portion 23 is configured in such a manner as to be capable of supporting the fan in the shell portion 21. The spoke portion 24 extends radially from the shell portion 21 and connects the shell portion 21 and the root portion 23. The spoke portion 24 may not simply connect the shell portion 21 and the root portion 23 but also be configured as a stator blade that rectifies currents of air produced by the fan. The coupling structure 10 is described below.

Figure 3A:
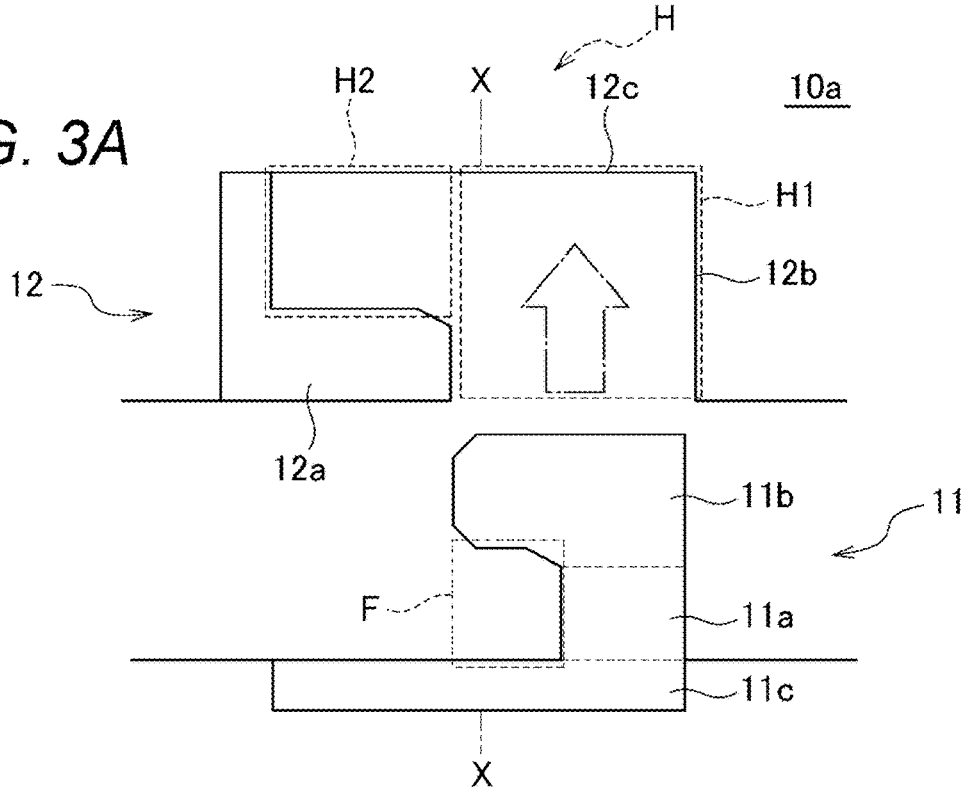
FIGS. 3A to 3C are diagrams illustrating a coupling structure of the axial fan according to the embodiment of the present disclosure.
Figure 3B:
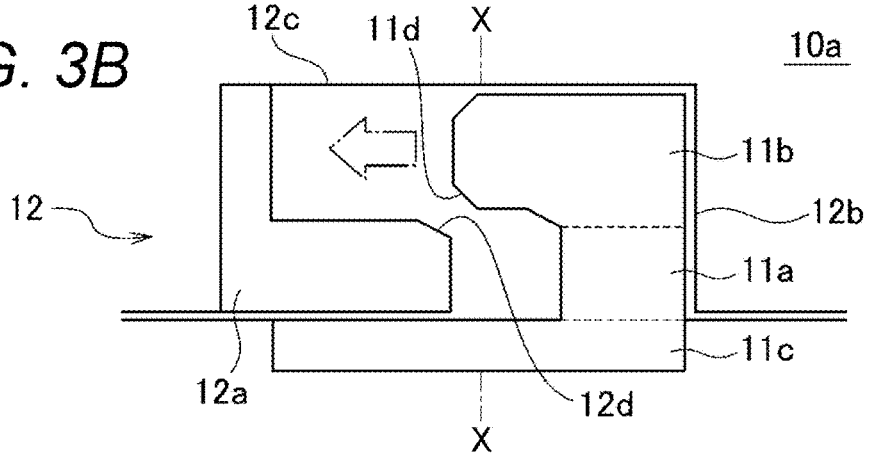
Figure 3C:
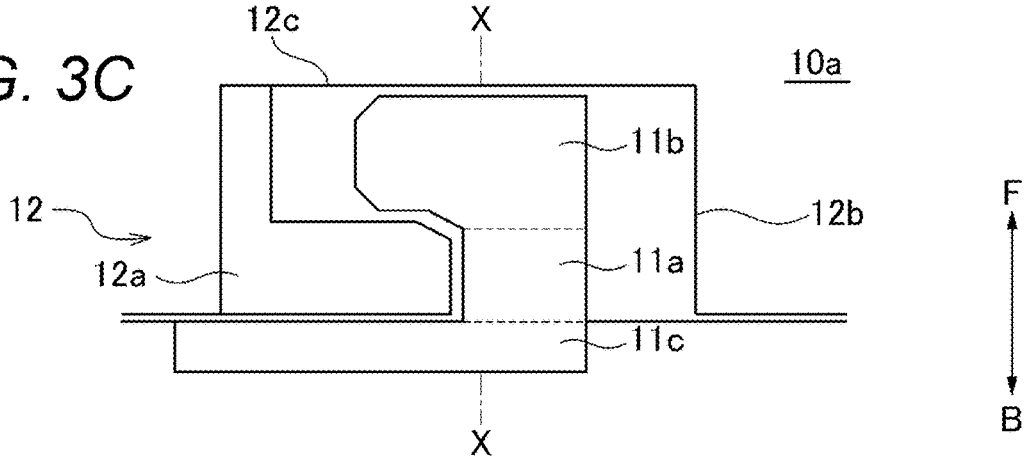

Next, the coupling structure 10 and a method for coupling the first housing 3*a* and the second housing 3*b* are described with reference to FIGS. 1 and 3A to 3B. FIGS. 3A to 3C are diagrams illustrating the coupling structure 10 of the axial fan 1 according to the embodiment. A first coupling pair 10*a* is illustrated as the coupling structure 10 of the embodiment.

As illustrated in FIG. 1, the first housing 3*a* and the second housing 3*b* are coupled by the coupling structure 10 provided to their respective shell portions 21. More specifically, as illustrated in FIGS. 3A to 3C, the first housing 3*a* includes a first coupling structure 11 as the coupling structure 10. The second housing 3*b* includes a second coupling structure 12 as the coupling structure 10. The first coupling structure 11 and the second coupling structure 12 form the first coupling pair 10*a*. In the axial fan 1 according to the embodiment, the first housing 3*a* and the second housing 3*b* are coupled by mating of the above-mentioned first coupling structure 11 and second coupling structure 12.

FIG. 3A is a diagram illustrating the first coupling structure 11 before coupling. FIG. 3B is a diagram illustrating the first coupling structure 11 during coupling. FIG. 3C is a diagram illustrating the first coupling structure 11 after coupling. As illustrated in FIG. 3A, the first coupling structure 11 is an approximately hook-shaped part protruding forward from a front end portion of the shell portion 21 of the first housing 3*a*. When the axial fan 1 according to the embodiment is viewed in a direction perpendicular to a direction of the rotation axis X, the first coupling structure 11 is located in the middle of the axial fan 1 in the direction of the rotation axis X of the axial fan 1. The first coupling structure 11 includes a first portion 11*a*, a second portion 11*b*, and a third portion 11*c*. The first portion 11*a* extends forward in the direction of the rotation axis X from the front end portion of the shell portion 21. The second portion 11*b* extends in a circumferential direction of the shell portion 21 from one end portion (a front end portion) of the first portion 11*a* in the direction of the rotation axis X. The third portion 11*c* extends in the circumferential direction from the other end portion (a back end portion) of the first portion 11*a* in the direction of the rotation axis X in such a manner as to face the second portion 11*b*. In the following description, a space defined by the first portion 11*a*, the second portion 11*b*, and the third portion 11*c* is called a first space F.

The second coupling structure 12 is a portion that forms a recessed portion H. The first coupling structure 11 fits in the recessed portion H. The recessed portion H is provided to a back end portion of the shell portion 21 of the second housing 3*b*. The second coupling structure 12 includes a fourth portion 12*a*, a side wall 12*b*, and an end wall 12*c*. The fourth portion 12*a* extends in the circumferential direction from the shell portion 21. The side wall 12*b* is provided at a position facing the fourth portion 12*a* in the circumferential direction. The end wall 12*c* extends parallel to the fourth portion 12*a* in the circumferential direction. Moreover, part of the second coupling structure 12 forms the recessed portion H in an outer peripheral portion of the second housing 3*b*. The recessed portion H is defined by the fourth portion 12*a*, the side wall 12*b*, and the end wall 12*c*. The recessed portion H includes an insertion groove H1 and a receiving groove H2. The insertion groove H1 is defined by the side wall 12*b* and the end wall 12*c*. The receiving groove H2 is defined by the fourth portion 12*a* and the end wall 12*c*.

In the axial fan 1 according to the embodiment, the coupling structure 10 including the first coupling structure 11 and the second coupling structure 12 is provided in such a manner that at least part of the coupling structure 10 is embedded in an outer peripheral side surface of the shell portion 21. In the embodiment, the second coupling structure 12 forms the recessed portion H recessed radially inward from the outer peripheral side surface of the shell portion 21. The first coupling structure 11 fits in the recessed portion H. Consequently, the coupling structure 10 is embedded in the shell portion 21.

Next, the process of coupling the first coupling structure 11 and the second coupling structure 12 is described in detail with reference to FIGS. 3A to 3C. In the following description, states of FIGS. 3A and 3B may be called the "non-coupled state." Moreover, a state of FIG. 3C may be called the "coupled state."

When the first coupling structure 11 and the second coupling structure 12 are coupled together, the first fan unit 2*a* moves in the direction of the rotation axis toward the second fan unit 2*b* first. The first portion 11*a* and the second portion 11*b* of the first coupling structure 11 are then inserted into the insertion groove H1 of the second coupling structure 12. At this point in time, the first portion 11*a* and the second portion 11*b* are inserted along the side wall 12*b* until the second portion 11*b* comes into contact with the end wall 12*c*. Therefore, it is possible to effect positioning of the first housing 3*a* in the direction of the rotation axis X relative to the second housing 3*b*.

Next, the first fan unit 2*a* rotates along the circumferential direction in such a manner that the second portion 11*b* of the first coupling structure 11 enters the receiving groove H2 of the second coupling structure 12 (refer to FIG. 3B). At this point in time, the first fan unit 2*a* rotates in such a manner that the fourth portion 12*a* enters the first space F of the first coupling structure 11. After the first housing 3*a* rotates, the fourth portion 12*a* comes into contact with the first portion 11*a*. Alternatively, the second portion 11*b* comes into contact with the fourth portion 12*a*. Therefore, the coupling structure 10 enters the coupled state (refer to FIG. 3C).

As illustrated in FIG. 1, the first coupling pair 10*a* is provided in such a manner that at least part of the first coupling pair 10*a* is embedded in the outer peripheral surface of the shell portion 21. A force for maintaining the coupling of the first fan unit 2*a* and the second fan unit 2*b* acts on the first coupling pair 10*a*. Hence, certain strength is required for the first coupling pair 10*a*. It is conceivable to secure a high thickness (radial dimension) of the first coupling pair 10*a* to secure the required strength. However, if the first coupling pair 10*a* is simply configured in such a manner as to protrude from the outer peripheral surface of the shell portion 21, when the axial fan is mounted, the structure may be an obstacle to the mounting.

Hence, according to the configuration of the axial fan according to the embodiment, at least part of the coupling structure 10 is embedded in the outer peripheral surface of the shell portion 21. Hence, it is possible to minimize the structure present on a side surface of the housing 3. Consequently, the strength required for the coupling structure 10 is secured. In addition, a space is secured on a circumferential surface of the axial fan 1. Hence, interference between the structures can be avoided when the axial fan 1 is installed in an external apparatus. Moreover, it is also possible to avoid a situation where the wiring is caught between the structures and crushed when the axial fan 1 itself is assembled. Hence, it is easy to assemble the axial fan 1. Moreover, the coupling structure 10 is provided on the surfaces of the shell portions 21. Hence, it is possible to couple the first fan unit 2*a* and the second fan unit 2*b* while visually checking the coupling structure 10. Hence, the coupling operation is easy. As described above, according to the axial fan 1 of the embodiment, it is possible to simplify the process of mounting the axial fan 1 and the process of assembling the axial fan 1 itself.

Figure 4:
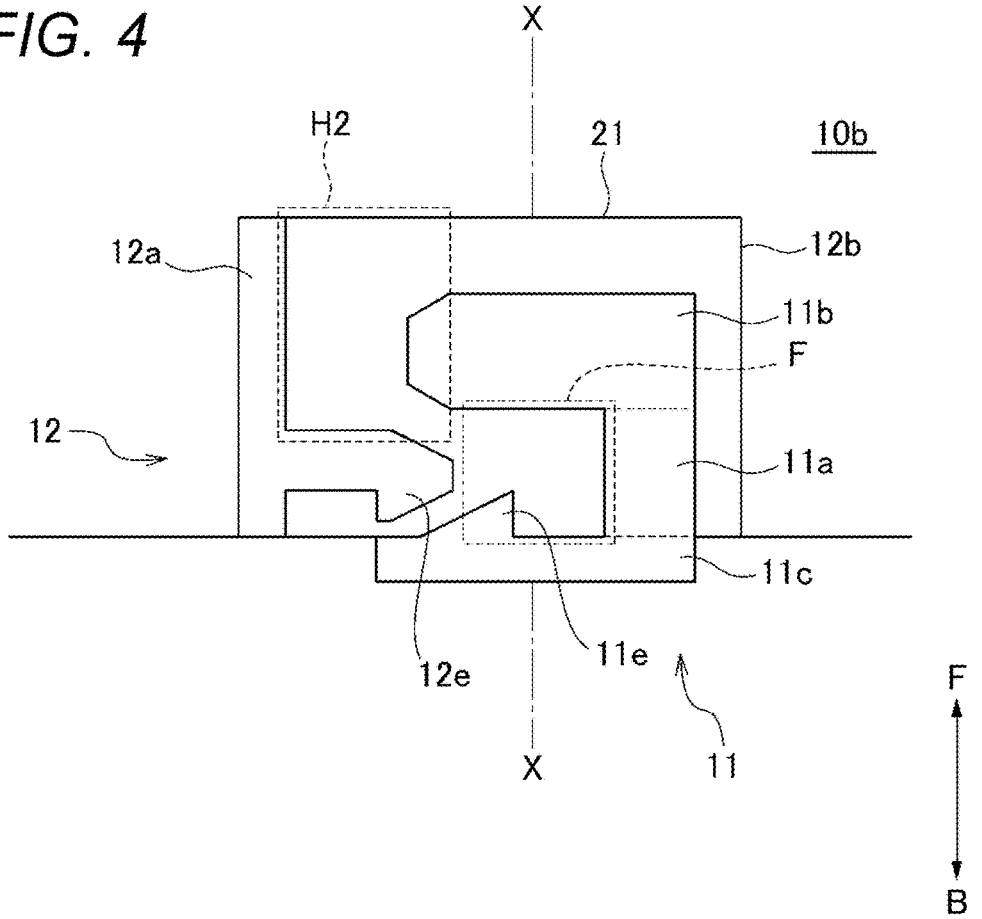
FIG. 4 is a diagram illustrating the coupling structure of the axial fan according to the embodiment of the present disclosure.

Moreover, as illustrated in FIG. 4, the axial fan 1 according to the embodiment may include, as the coupling structure 10, a second coupling pair 10*b* having a different structure from the first coupling pair 10*a*. A third portion 11*c* of the second coupling pair 10*b* may be provided with a first latch portion 11*e*. Moreover, a fourth portion 12*a* is provided with a second latch portion 12*e*. The other configurations are similar to the configurations of the first coupling pair 10*a*. The first latch portion 11*e* is a projection extending in the direction of the rotation axis X from the third portion 11*c* toward a first space F. The second latch portion 12*e* is a projection extending from an end portion on a side wall 12*b* side of the fourth portion 12*a* in a direction opposite to a direction toward an end wall 12*c* (FIG. 3C) in the direction of the rotation axis X.

When the second coupling pair 10*b* shifts from the non-coupled state to the coupled state, the second latch portion 12*e* of the fourth portion 12*a* moves over the first latch portion 11*e* and enters the first space F. At this point in time, the second latch portion 12*e*, which has entered the first space F, functions as a "barb" in cooperation with the first latch portion 11*e*. Consequently, the first latch portion 11*e* and the second latch portion 12*e* make it more difficult for the fourth portion 12*a* to be pulled out of the first space F. Furthermore, each of the first latch portion 11*e* and the second latch portion 12*e* extends in the direction of the rotation axis X. Hence, the first latch portion 11*e* and the second latch portion 12*e* are engaged with each other, which enables the positioning of the first fan unit 2*a* and the second fan unit 2*b* in the circumferential direction. From the above reasons, according to the second coupling pair 10*b*, it is possible to determine the relative positions of the first fan unit 2*a* and the second fan unit 2*b* in the circumferential direction with high accuracy.

In the axial fan 1 according to the embodiment, each of the second portions 11*b* may be provided with a first guide surface 11*d*. Moreover, each of the fourth portions 12*a* may be provided with a second guide surface 12*d*. In the embodiment, as illustrated in FIGS. 3A to 3C and FIG. 4, the first guide surface 11*d* has a structure where a corner of a distal end of the second portion 11*b* is cut off. More specifically, the first guide surface 11*d* is formed by cutting off the corner of the second portion 11*b*. In this case, the corner of the second portion 11*b* is cut off along a direction that does not restrict the rotation of the first coupling structure 11 when the coupling structure 10 shifts from the non-coupled state (FIG. 3B) to the coupled state (FIG. 3C). As in the first guide surface 11*d*, the second guide surface 12*d* has a structure where a corner of a distal end of the fourth portion 12*a* is cut off. In this manner, the second portion 11*b* is provided with the first guide surface 11*d*. Moreover, the fourth portion 12*a* is provided with the second guide surface 12*d*. Consequently, even if the second portion 11*b* and the fourth portion 12*a* come into contact with each other during coupling, the first guide surface 11*d* and the second guide surface 12*d* come into surface contact with each other. Hence, the rotation of the first coupling structure 11 is not restricted. Consequently, the first fan unit 2*a* and the second fan unit 2*b* can be smoothly coupled together. Note that each of the first latch portion 11*e* and the second latch portion 12*e*, which are illustrated in FIG. 4, may also be provided with a similar guide surface.

Up to this point the axial fan 1 according to the embodiment has been described. However, the axial fan 1 according to the embodiment is not limited to the axial fan that has been described. For example, the axial fan 1 according to the embodiment may be configured in such a manner that at least one of the first portion 11*a* and the second portion 11*b* is elastically deformable. According to this configuration, it is possible to reduce the force that is added to the first fan unit 2*a* and the second fan unit 2*b* when the axial fan 1 is assembled and disassembled. Hence, the first fan unit 2*a* and the second fan unit 2*b* can be easily attached and detached. Consequently, it is possible to provide the axial fan 1 that allows easy assembly, disassembly, and reassembly.

Figure 5:
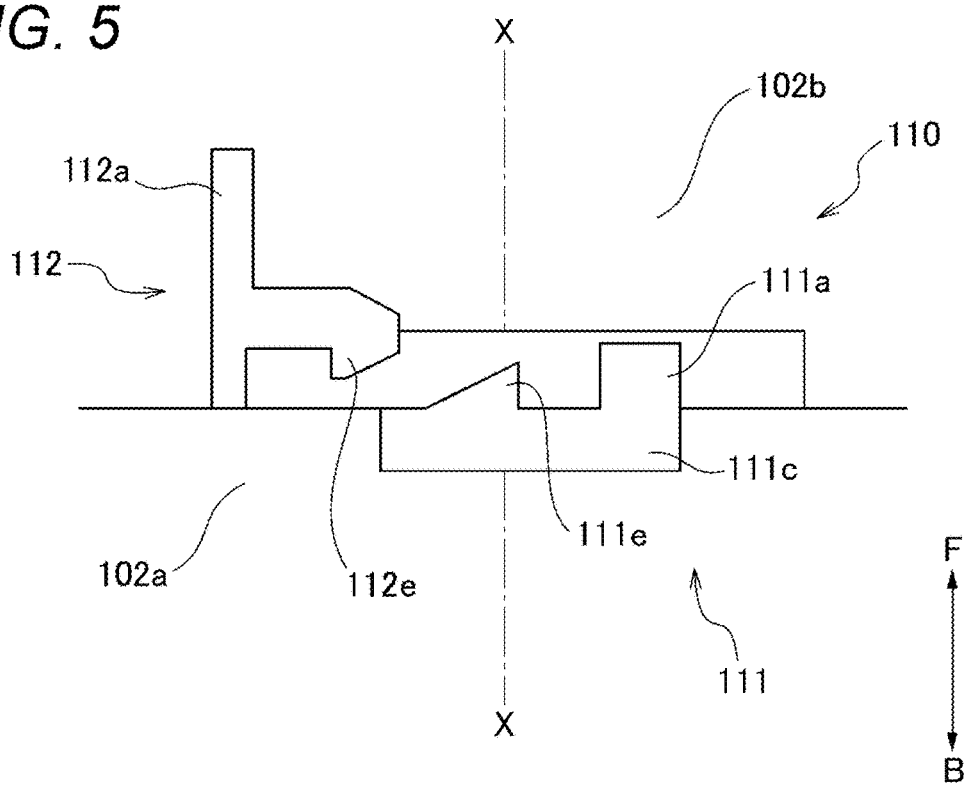
FIG. 5 is a diagram illustrating a coupling structure of an axial fan according to another embodiment of the present disclosure.

Moreover, the coupling structure 10 of the axial fan 1 according to the embodiment may not be provided with the second portion 11*b* of the first coupling structure 11. FIG. 5 illustrates a coupling structure 110 of an axial fan 1 according to another embodiment of the present disclosure. According to the axial fan 1 illustrated in FIG. 5, a first latch portion 111*e* provided to a third portion 111*c* of a first coupling structure 111 and a second latch portion 112*e* provided to a fourth portion 112*a* of a second coupling structure 112 allow positioning of a first fan unit 102*a* and a second fan unit 102*b* in a circumferential direction relative to each other. Moreover, according to the embodiment, the coupling structure can be reduced in size. Hence, a space can be secured more easily on a circumferential surface of the axial fan 1.

Up to this point the embodiments of the present disclosure have been described. However, it is needless to say that the technical scope of the embodiments should not be construed in a limited manner by the embodiments described above. The embodiments that have been described are mere examples. Those skilled in the art understand that the embodiments that have been described can be modified in various manners within the scope described in the claims. The technical scope of the embodiments should be determined on the basis of the scope described in the claims and the scope of equivalents thereof.

What is claimed is:

1. An axial fan comprising:

a first fan unit; and a second fan unit, wherein the first fan unit and the second fan unit are coupled in a direction of a rotation axis, the first fan unit includes a first housing for accommodating a first fan, the second fan unit includes a second housing for accommodating a second fan, each end portion of the axial fan in the direction of the rotation axis is provided with a base portion, a cylindrical shell portion is provided between the base portions provided to the end portions, and is formed by the first housing and the second housing, a first coupling pair of the first fan unit and the second fan unit is provided, a second coupling pair of the first fan unit and the second fan unit is provided, each of the first and second coupling pairs includes a first coupling structure and a second coupling structure, at least part of each first coupling structure protrudes in the direction of the rotation axis from an end portion of the first housing in the direction of the rotation axis toward the second fan, each second coupling structure is provided to the second housing, each first coupling structure is configured in such a manner as to fit into the respective second coupling structure upon the first fan unit and the second fan unit coming closer to each other in the direction of the rotation axis and then rotating about the rotation axis, and at least part of one of the first and second coupling pairs is embedded in an outer peripheral side surface of the shell portion, each first coupling structure includes a first portion, a second portion, and a third portion, each first portion extends in the direction of the rotation axis, each second portion extends in a circumferential direction of the shell portion from one end portion in an axial direction of the respective first portion, each third portion extends in the circumferential direction from the other end portion in the axial direction of the respective first portion in such a manner as to face the respective second portion, each second coupling structure includes a fourth portion and a receiving groove, each fourth portion extends in the circumferential direction toward a region defined by the respective first portion, the respective second portion, and the respective third portion, and the third portion, each receiving groove allows the respective second portion- to enter into one side in the axial direction further than the respective fourth portion, each receiving groove is formed as a recessed portion in an outer peripheral surface of the second housing, each of the third portion and the fourth portion of the first coupling pair is provided with a latch portion, the latch portions are configured to determine relative positions of the first fan unit and the second fan unit, and each of the third portion and the fourth portion of the second coupling pair is not provided with the latch portion.

2. The axial fan according to claim 1, wherein each of a distal end of each second portion and a distal end of each fourth portion includes a guide surface to facilitate entrance of the respective fourth portion into the respective region.

3. The axial fan according to claim 1, wherein at least one of the each first portion and each second portion is configured to be elastically deformable.

4. The axial fan according to claim 2, wherein a corner of the distal end of each second portion is cut off, and a corner of the distal end of each fourth portion is cut off.

* * * * *